US007347196B1

(12) United States Patent
Shepley, Jr. et al.

(10) Patent No.: US 7,347,196 B1
(45) Date of Patent: Mar. 25, 2008

(54) SIGHT MOUNTING SYSTEM

(75) Inventors: Paul E. Shepley, Jr., Tucson, AZ (US); Allen C. Rasor, Jr., Marana, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 11/226,105

(22) Filed: Sep. 14, 2005

Related U.S. Application Data

(62) Division of application No. 10/745,132, filed on Dec. 22, 2003, now Pat. No. 6,968,837.

(51) Int. Cl.
*F41B 5/00* (2006.01)
*F41G 1/467* (2006.01)

(52) U.S. Cl. ..... 124/87; 124/88

(58) Field of Classification Search ..... 124/23.1, 124/25.6, 86, 87, 88
See application file for complete search history.

(56) References Cited

U.S. PATENT DOCUMENTS 2,642,661 A * 6/1953 Fredrickson ..... 124/87
4,616,623 A 10/1986 Williams
4,697,350 A 10/1987 Sepley et al.
5,005,554 A * 4/1991 Shepley et al. ..... 124/24.1
5,123,396 A 6/1992 Shepley et al.
5,694,698 A 12/1997 Slates
5,718,215 A 2/1998 Kenny et al.
5,722,175 A 3/1998 Slates
5,803,070 A * 9/1998 Martin et al. ..... 124/88
5,893,356 A 4/1999 Johns
6,644,297 B1 11/2003 Brown, Jr.
2002/0017027 A1 2/2002 Beshires
2002/0073559 A1 6/2002 Johnson
2002/0162232 A1 11/2002 Gomez-Vazquez
2003/0041850 A1 3/2003 Martin et al.

OTHER PUBLICATIONS

"AMO Standards", Archery Manufacturers and Merchants Organization, AMO Standards Committee, Field Publication FP-3, 2000, pp. 1-16.

* cited by examiner

*Primary Examiner*—John A. Ricci
(74) *Attorney, Agent, or Firm*—Cahill, von Hellens & Glazer P.L.C.

(57) ABSTRACT

A riser (102) of an archery bow (100) has plurality of holes (200) at least partially through the riser for use in attaching a sight mount (114) to the bow. In one embodiment, the plurality of holes includes eighteen holes (201-218). The eighteen holes are grouped into a top group (228) and a bottom group (229). The eighteen holes include nine pairs of holes. Each pair consists of a preselected one hole from the top group and a preselected one hole from the bottom group. Each pair of holes is usable to attach a sight mount to the riser at a different vertical position on the riser. In another embodiment, the riser has a pair of vertically oriented slots (701) and (702). The abstract is submitted with the understanding that it will not be used to interpret or limit the scope or meaning of the claims pursuant to 37 C.F.R. §1.72(b).

6 Claims, 4 Drawing Sheets

SIGHT MOUNTING SYSTEM

RELATED U.S. APPLICATION

This is a divisional application of U.S. patent application Ser. No. 10/745,132 filed Dec. 22, 2003 now U.S. Pat. No. 6,968,837, which is hereby fully incorporated by reference herein.

BACKGROUND OF THE INVENTION

1. Field of the Invention

This invention relates generally to archery bows, and more particularly to a bow handle to which a mount for a bow sight is attachable.

2. Description of the Related Art

Some archery bows have sights to facilitate aiming of arrows projected therefrom. Such sights have a front portion and a rear portion. The rear portion of the sight usually comprises a string peep mounted to the bowstring. The front portion of the sight (hereinafter referred to as the "sight") usually comprises one or more sight pins. The sight is attached to a sight mount. The sight mount has mounting holes. The sight mount is attached to a bow handle, or riser, of the bow by two screws through the mounting holes, which engage with two holes located on the outside of the bow window of the riser. The two holes in the riser are 10-24 threaded holes spaced 1.312 inches apart. A line through the axis of the two holes in the riser is parallel to the bowstring. The foregoing specifications are enunciated in an industry standard promulgated by the Archery Trade Association of Salt Lake City, Utah. The industry standard also states that mounting holes in sight mounts should have holes that conform to the foregoing specifications.

Sights that have sight pins that are vertically adjustable within the sight are well known. Also well known are sights that are vertically adjustable with respect to the sight mount. For example, U.S. Pat. No. 4,697,350 entitled COMBINATION ARROW QUIVER AND SIGHT SUPPORT MOUNT issued Oct. 6, 1987 to Shepley, et al., and U.S. Pat. No. 5,123,396 entitled ACCESSORY MOUNT issued Jun. 23, 1992 to Shepley et al., disclose a sight mount that includes a sight bracket segment that has longitudinal slots for mounting the sight at various vertical positions with respect to the sight mount.

Sight mounts that are adjustable horizontally with respect to the riser are also known.

Sight mounts that have a provision on the sight mount for adjusting the sight mount vertically with respect to the riser are well known. One example of such provision includes a plurality of mounting holes in the sight mount. U.S. Pat. No. 5,718,215 entitled ADJUSTABLE BOW SIGHT issued Feb. 17, 1998 to Kenny, et al., has a plurality of spaced-apart, recessed or countersunk apertures for receiving a pair of fasteners, such as screws, to connect the sight mount to the riser. Another example of such provision includes a pair of elongated slots, instead of circular holes for the mounting holes in the sight mount. U.S. Pat. No. 4,616,623 entitled INTERCHANGEABLE SIGHT MOUNT FOR BOWS issued Oct. 14, 1986 to Williams, discloses a sight mount composed of four primary components—including a bow mounting bracket comprising a first leg. The first leg has several mounting slots adapted to receive threaded fasteners for affixing the bow mounting bracket to the riser. The slots are oriented vertically, thereby permitting adjustment of the vertical position of the sight mount with respect to the riser. U.S. Patent Application Publication No. US 2002/0017027

A1, published Feb. 14, 2003, entitled REAR SIGHT ATTACHMENT FOR ARCHERY BOWS by Beshires, discloses a mount for a rear portion only, which has slots that allow the rear portion to be adjustable vertically with respect to the riser.

U.S. Pat. No. 6,644,297 entitled SCOPE MOUNT FOR ARCHERY issued Nov. 11, 2003 to Brown, Jr., discloses a sight mount comprising three brackets, in which a first bracket is attached to the riser, and a second bracket is vertically adjustable relative to the first bracket by sliding in slots. However, the first bracket is not vertically adjustable relative to the riser.

However, many sight mounts do not have any provision for adjusting the sight mount vertically with respect to the riser. Furthermore, all known risers lack any provision, on the riser, for accepting attachment of the sight mount to more than one vertical position on the riser.

Consequently, all known mounting systems, when used with one of the many sight mounts that lacks any provision for adjusting the sight mount vertically with respect to the riser, allow only a single vertical position at which to use the sight mount. Many archers would prefer to use such non-adjustable sight mounts, but would also prefer to have the ability to choose the vertical position for attachment of the non-adjustable sight mount to the riser. A single attachment position is not suitable for all archers. The attachment position depends, among others things, on the size of the archer and the technique of the archer.

There is a trend for sights and sight mounts to be made smaller. As a result, less space becomes available on the sight and sight mount for a vertical adjustment means.

OBJECTS OF THE INVENTION

It is therefore an object of the present invention to provide an archery bow that moves the vertical adjustment means from the sight mount to the riser.

It is therefore another object of the present invention to provide an archery bow that has a provision on the riser for vertically adjusting a sight mount with respect to the riser.

It is still another object of the present invention to provide a riser that has a provision for accepting attachment of a sight mount at more than one position on the riser.

It is yet another object of the present invention to provide a sight mounting system for an archery bow, which can vertically adjust the position of use on the riser of a vertically non-adjustable sight mount.

These and other objects of the present invention will become apparent to those skilled in the art as the description thereof proceeds.

SUMMARY OF THE INVENTION

Briefly described, and in accordance with a preferred embodiment thereof, the present invention relates to an archery bow that has a riser for attachment thereto of a sight mount, a first limb and a second limb extending from said riser, and a bowstring strung between ends of the first limb and the second limb. The riser includes a plurality of adjacent pairs of spaced-apart holes extending at least partially through the riser for use in attaching the sight mount to the riser. Each hole has an axis and positioned such that a line through the axis of the holes is substantially parallel to the bowstring. The two holes of each pair of holes are spaced apart a predetermined distance. Each adjacent pair of holes is spaced apart less than said predetermined distance.

Another aspect of the present invention relates to an archery bow for use with a vertically non-adjustable sight mount, in which the archery bow comprises a riser, a first limb and a second limb attached to opposite sides of the riser, and means on the riser for vertically adjusting the sight mount.

Still another aspect of the invention relates to an improvement in an archery bow for use with a sight mount. The archery bow comprises a riser, and a first limb and a second limb attached to opposite sides of the riser. The improvement is a provision on the riser for accepting attachment of a sight mount at more than one position on the riser.

Yet another aspect of the invention relates to an archery bow that has a riser for attachment thereto of a sight mount, a first limb and a second limb extending from said riser, and a bowstring strung between ends of the first limb and the second limb. The riser includes a pair of spaced-apart slots extending through the riser for use in attaching the sight mount to the riser. The slots have a longitudinal axis, and the longitudinal axis of the slots is substantially parallel to the bowstring.

Other aspects, features and advantages of the present invention will become apparent to those skilled in the art from the following detailed description and the accompanying drawings. It should be understood however that the detailed description and specific examples, while indicating preferred embodiments of the present invention, are given by way of illustration only and various modifications may naturally be performed without deviating from the present invention.

BRIEF DESCRIPTION OF THE DRAWINGS

The present invention will be described with greater specificity and clarity with reference to the following drawings, in which.

Figure 1:
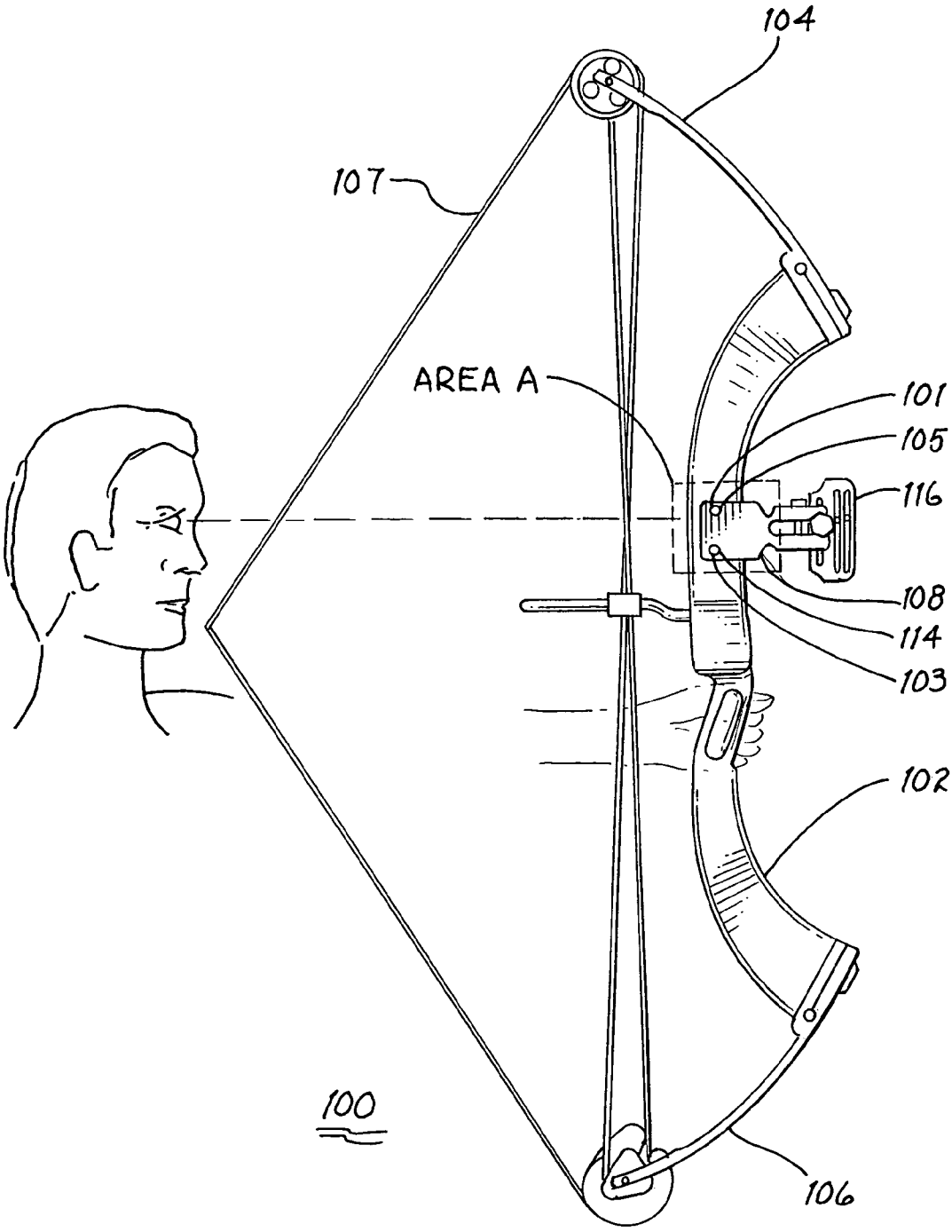
FIG. 1 is a right side view of an archery bow showing a sight mount attached to a riser of an archery bow, and a sight attached to the sight mount.

For simplicity and clarity of illustration, the drawing figures illustrate the general manner of construction, and descriptions and details of well-known features and techniques are omitted to avoid unnecessarily obscuring the invention. Additionally, elements in the drawing figures are not necessarily drawn to scale.

DESCRIPTION OF THE PREFERRED EMBODIMENT

It should be understood that the embodiments discussed below are only examples of the many advantageous uses of the innovative teachings herein. In general, statements made in the specification of the present application do not necessarily limit any of the various claimed inventions. In general, unless otherwise indicated, singular elements may be in the plural and vice versa with no loss of generality. The terms first, second, third, and the like, in the description and in the claims, if any, are used for distinguishing between similar elements and not necessarily for describing a sequential or chronological order. The terms top, front, side, and the like, in the description and in the claims, if any, are used for descriptive purposes and not necessarily for describing relative positions. All measurements are approximate, for example, "0.275 inch" means, "0.275 inch, more or less".

FIG. 1 is a right side view of a single-cam compound bow, or bow 100. The bow 100 comprises a center handle, or riser, 102, a first limb 104 and a second limb 106 attached to opposite sides of the riser, and a bowstring 107 strung between outer ends of the first limb and the second limb. A sight mount 108 is attached to the riser 102. The sight mount 108 is an industry-standard sight mount, and has two mounting holes 101 and 103. In FIG. 1, the sight mount 108 is shown attached to the riser 102 at a vertically intermediate position. The sight mount 108 is attached to the riser 102 by two fasteners, preferably threaded fasteners, such as screw 105 that mates with a top hole 205 and screw 114 that mates with a bottom hole 214 of a plurality of holes 200 (see FIG. 2) in the riser. The top hole 205, the bottom hole 214 and the plurality of holes 200 in the riser 102 are not visible in FIG. 1 because of the presence of the sight mount 108. A sight 112 is attached to the sight mount 108.

Figure 2:
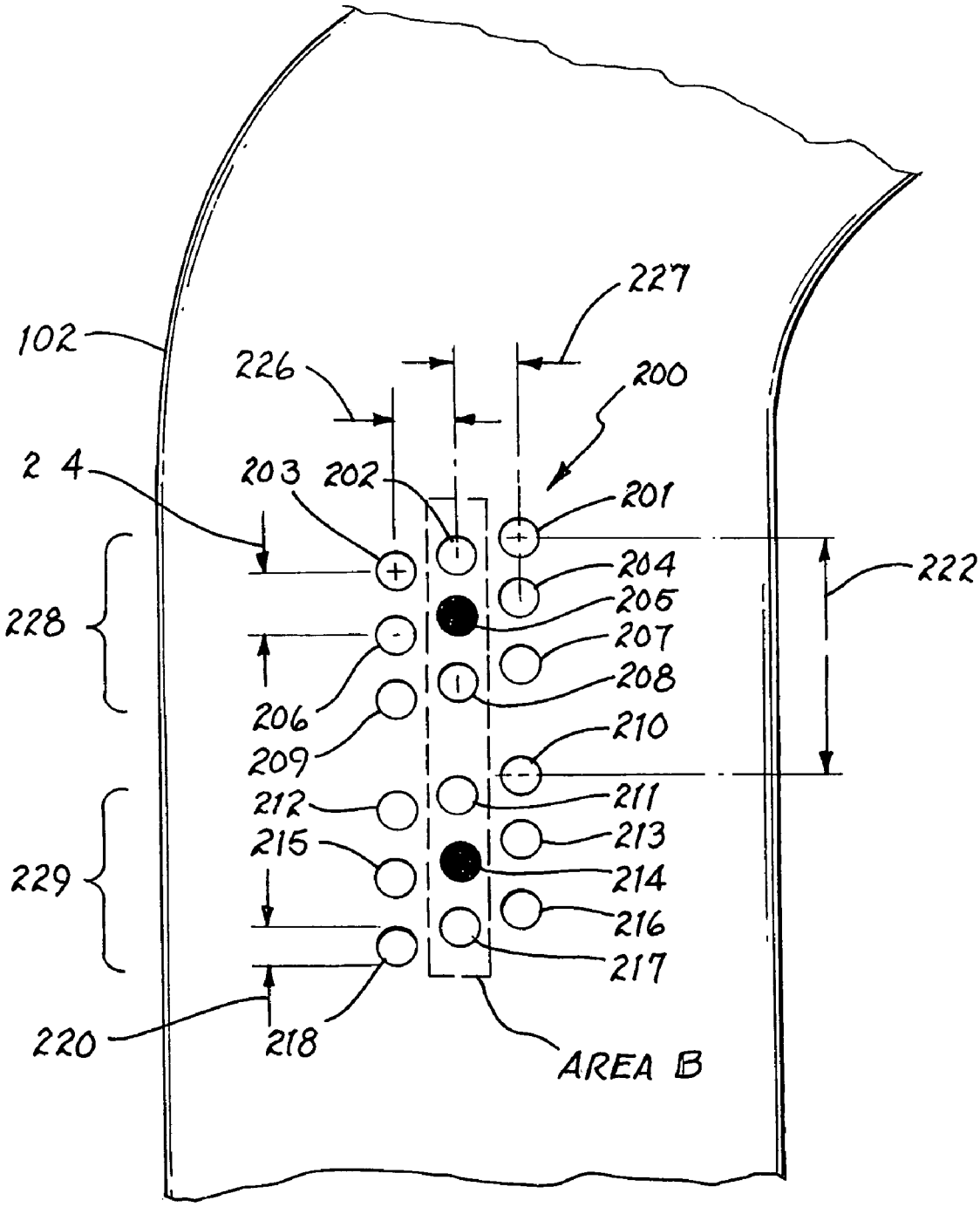
FIG. 2 is an enlarged right side view of area A of FIG. 1, but without the sight mount, showing a plurality of pairs of holes in the riser.

FIG. 2 is an enlarged right side view of dotted-line area A of FIG. 1, but without the sight mount, showing the plurality of holes 200 in the riser. The plurality of holes 200 comprises eighteen (18) holes 201-218. Each hole has a diameter 220 of a 10-24 threaded hole. The plurality of holes 200 comprises a top group 228 of top holes 201-209, and a bottom group 229 of bottom holes 210-218. The plurality of holes also comprises several pairs of holes. Each pair of holes comprises one top hole and one bottom hole. The top hole and the bottom hole of each pair are spaced apart an industry-standard distance 222 of 1.312 inch. The plurality of holes comprises nine (9) pairs of holes. For example, top hole 201 and bottom hole 210 form a first pair; top hole 202 and bottom hole 211 form a second pair; top hole 203 and bottom hole 212 form a third pair; top hole 209 and bottom hole 218 form a ninth pair, etc. Adjacent top holes are spaced apart a shorter distance 224 in accordance with the invention. Adjacent bottom holes are also spaced apart the shorter distance 224 in accordance with the invention. The shorter distance 224 between adjacent top holes is preferably 0.275 inch, and the shorter distance between adjacent bottom holes is also preferably 0.275 inch. Preferably, the holes 200 extend completely through the riser 102. Alternatively, the holes 200 extend partially through the riser 102, for example 0.375 inch through the riser. In a preferred embodiment, the plurality of holes 200 in the riser 102 comprises three pairs of holes, or six (6) holes 202, 205, 208, 211, 214 and 217, as indicated by the dotted-line rectangle, Area B, of FIG. 2. The distances 226 and 227 between vertical columns of holes is foreseen to be equal, and the sizes of distances 226 and 227 are a design choice. A choice is 0.275 inch. It is foreseen that the distances 226 and 227 are as small as practical, because movement of the sight mount 108 in a horizontal direction is beyond the scope of the invention.

In an alternative embodiment of the riser (not shown), each hole 201-218 has a diameter 220 of 0.20 inch, and is not threaded. Because the holes 201-218 in the alternative embodiment do not have threads, a nut on the side of the riser 102 opposite the sight mount 108 is used with the two threaded fasteners, such as two bolts that replace the screws 105 and 114, respectively, to secure the sight mount to the riser at a vertical position chosen by the archer.

Figure 3:
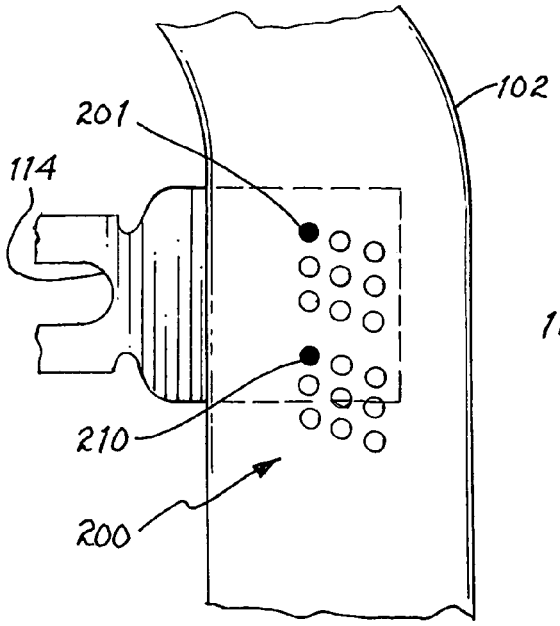
FIG. 3 is a left side view of area A of FIG. 1, showing the sight mount attached to the riser at a highest position.

FIG. 3 is a left side view of area A of FIG. 1, showing the sight mount 108 attached to the riser 102 at a highest position. In FIG. 3, the screws 105 and 114 that hold the sight mount 108 to the riser 102 are mated to the highest pair of holes in the riser 201. In FIG. 3, screw 105 mates with hole 201, and screw 114 mates with hole 210.

Figure 4:
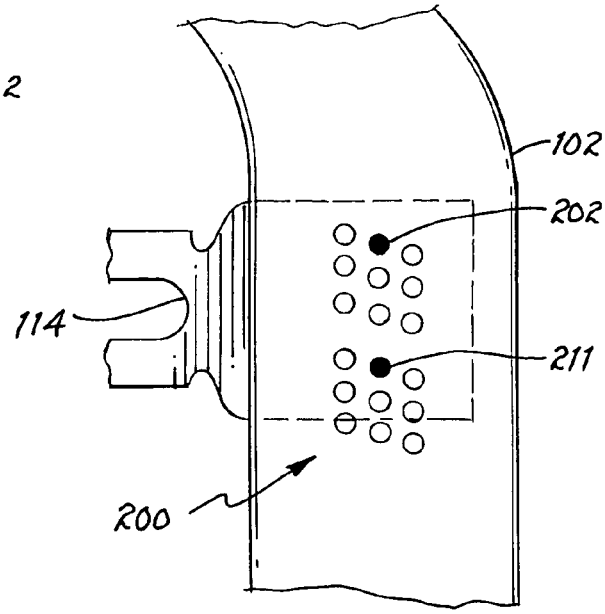
FIG. 4 is a left side view of area A of FIG. 1, showing the sight mount attached to the riser at a second highest position.

FIG. 4 is a left side view of area A of FIG. 1, showing the sight mount 108 attached to the riser 102 at a second highest position. In FIG. 4, the screws 105 and 114 that hold the sight mount 108 to the riser 102 are mated to the second highest pair of holes in the riser 201. In FIG. 4, screw 105 mates with hole 202, and screw 114 mates with hole 211.

Figure 5:
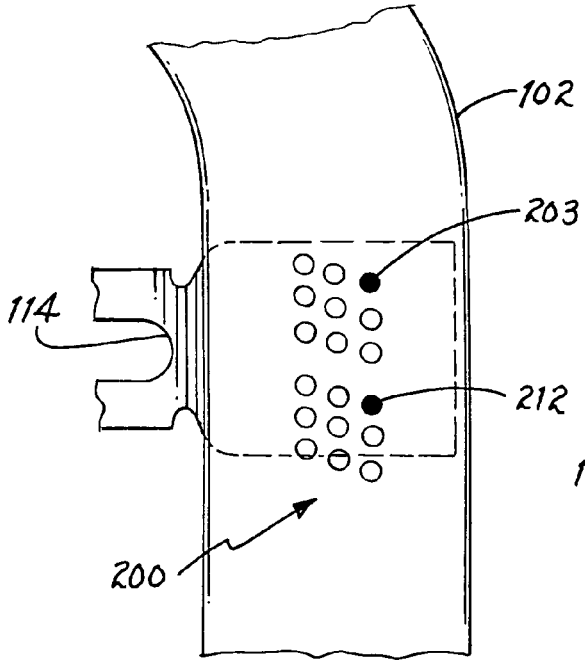
FIG. 5 is a left side view of area A of FIG. 1, showing the sight mount attached to the riser at a third highest position.

FIG. 5 is a left side view of area A of FIG. 1, showing the sight mount 108 attached to the riser 102 at a third highest position. In FIG. 5, the screws 105 and 114 that hold the sight mount 108 to the riser 102 are mated to the third highest pair of holes in the riser 201. In FIG. 5, screw 105 mates with hole 203, and screw 114 mates with hole 212.

Figure 6:
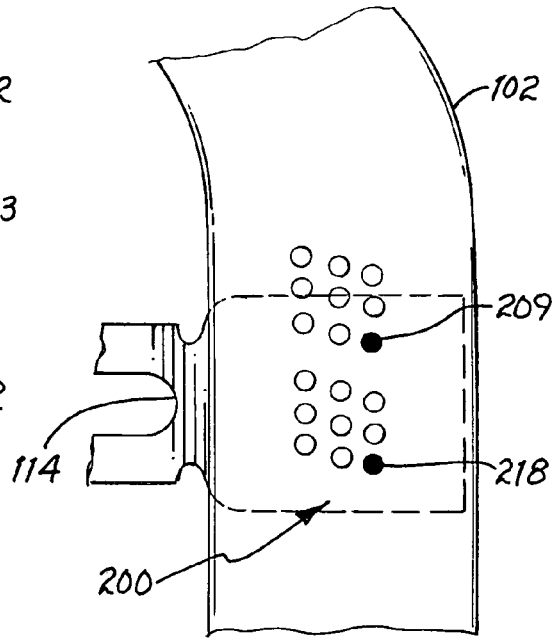
FIG. 6 is a left side view of area A of FIG. 1, showing the sight mount attached to the riser at a lowest position.

FIG. 6 is a left side view of area A of FIG. 1, showing the sight mount 108 attached to the riser 102 at a lowest position. In FIG. 6, the screws 105 and 114 that hold the sight mount 108 to the riser 102 are mated to the lowest pair of holes in the riser 201. In FIG. 6, screw 105 mates with hole 209, and screw 114 mates with hole 218.

Figure 7:
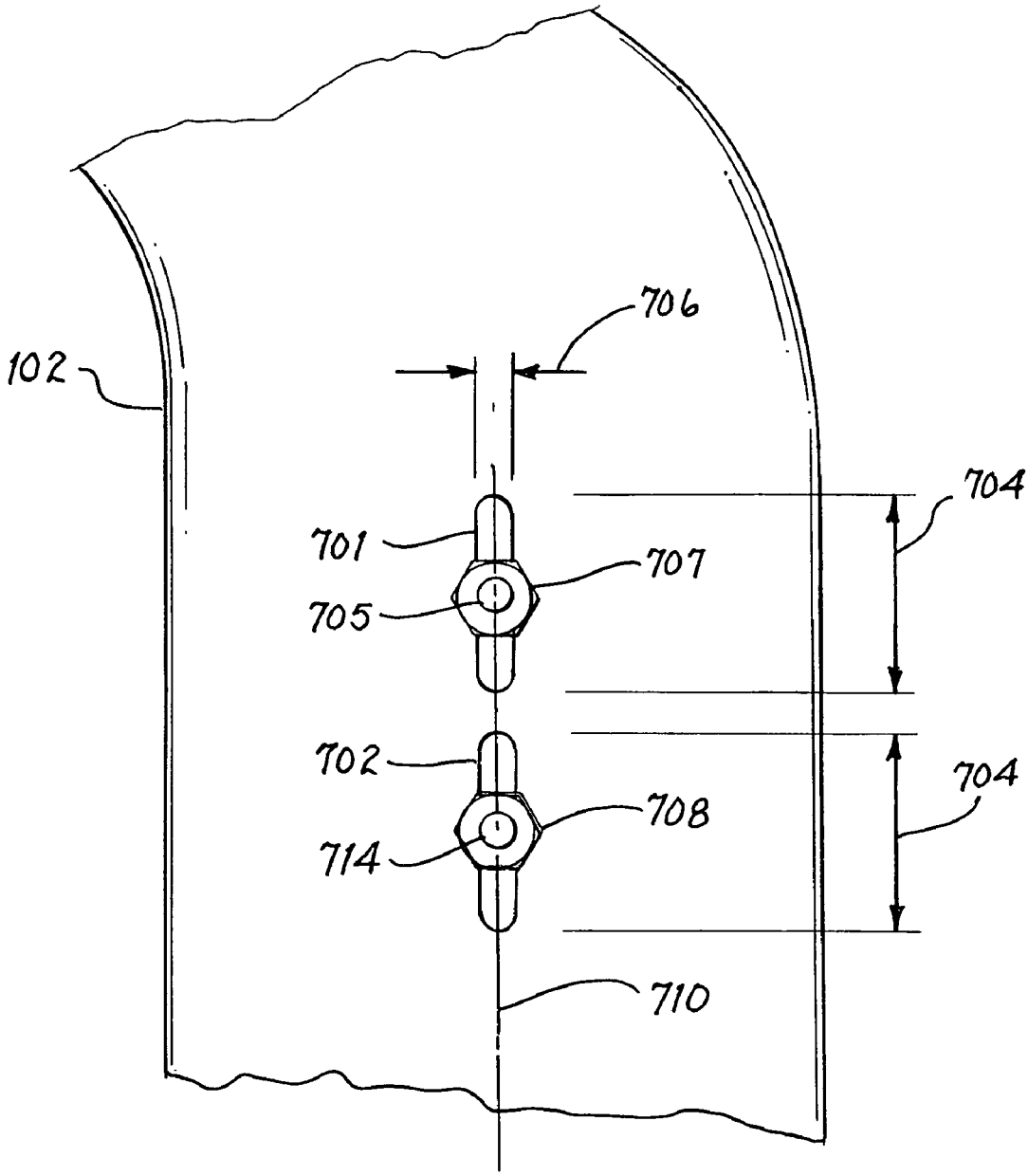
FIG. 7 is an enlarged left side view of area A of FIG. 1, but without the sight mount, showing a pair of vertically oriented slots in the riser.

FIG. 7 is an enlarged left side view of area A of FIG. 1, but without the sight mount 108, showing a pair of vertically oriented slots 701 and 702 in the riser, showing an alternate embodiment of the riser 102 in accordance with the invention. The slot length 704 of each slot is 1.333 inches. The slot width 706 of each slot is 0.20 inch to snugly accept a 10-24 threaded bolt. Because the slots 701 and 702 do not have threads, a nut 707 and 708 on the side of the riser 102 opposite the sight mount 108 is used with each of the two threaded fasteners, such as bolts 705 and 714, to secure the sight mount to the riser at an intermediate vertical position chosen by the archer. The slots have a longitudinal axis 710 substantially parallel to the bowstring 107. As a further alternative, one long slot (not shown) is used instead of the two slots 701 and 702. The slot width of the one long slot is also 0.20 inch. The length of the one long slot is 2.645 inches.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims. For example, the invention is not limited to a single-cam compound bow, but is equally applicable to a dual-cam compound bow, to any type of compound bow, and to any type of archery bow. The invention is not limited to the number of pairs of holes given as examples, and it is foreseen that there be a greater or fewer number of pairs of holes in the riser for attaching the sight mount thereto. The invention is not limited to use in attaching a sight mount to the riser, and it is foreseen that the invention can be used in attaching other accessories to the riser.

We claim:

1. In an archery bow having a riser for attachment thereto of a sight mount, a first limb and a second limb extending from said riser, and a bowstring strung between ends of the first limb and the second limb, the improvement comprising:

a pair of elongated spaced-apart slots, comprising a top slot and a bottom slot, extending through the riser for use in attaching the sight mount to the riser, each of the pair of slots having a height greater than width, and having a longitudinal axis extending the height of the slot, the longitudinal axis of the top slot being substantially coincident with the longitudinal axis of the bottom slot, the longitudinal axis of each of the pair of slots being substantially parallel to the bowstring;

and a pair of fasteners engaged through said pair of slots for securing the sight to the riser.

2. The improvement of claim 1, wherein said pair of fasteners is comprised by:

a top fastener, and a bottom fastener wherein said top fastener is engaged through said top slot, and wherein said bottom fastener is engaged through said bottom slot.

3. The improvement of claim 1, including:

a fastener distance defined by a vertical displacement between position of the pair of fasteners;

a slot distance defined by a vertical displacement between said top slot and said bottom slot;

wherein said fastener distance being substantially equivalent to said slot distance.

4. The improvement of claim 3, where in the height of the top slot is less than said fastener distance.

5. The improvement of claim 3, where in the height of the bottom slot is less than said fastener distance.

6. The improvement of claim 1, where said pair of elongated spaced-apart slots are positioned on the riser relatively above a grip.

* * * * *